United States Patent [19]

Kennedy

[11] 4,025,864

[45] May 24, 1977

[54] DIRECT CURRENT MODULATOR FOR PROVIDING VARIABLE DOUBLE FREQUENCY ELECTRICAL POWER TO A LOAD

[75] Inventor: Theodore R. Kennedy, Willingboro, N.J.

[73] Assignee: Inductotherm Corporation, Rancocas, N.J.

[22] Filed: Aug. 4, 1975

[21] Appl. No.: 601,817

Related U.S. Application Data

[63] Continuation-in-part of Ser. No. 227,751, Feb. 22, 1972, which is a continuation-in-part of Ser. No. 99,170, Dec. 17, 1970, abandoned.

[52] U.S. Cl. ..... 321/68; 219/10.75; 323/75 S; 323/89 B

[51] Int. Cl.[2] ..... H05B 5/06

[58] Field of Search ..... 13/12, 24, 26, 27; 219/10.75, 10.77; 321/9 R, 10, 60, 68; 323/24, 75 S, 75 M, 89 R, 89 B

[56] References Cited

UNITED STATES PATENTS

| | | | |
|---|---|---|---|
| 1,745,378 | 2/1930 | Osnos | 323/75 S |
| 2,414,317 | 1/1947 | Middel | 323/75 S |
| 2,683,854 | 7/1954 | Conrath | 321/25 |
| 2,827,603 | 3/1958 | Fingerett et al. | 323/89 B |
| 2,866,943 | 12/1958 | Ringelman | 321/25 |
| 2,883,505 | 4/1959 | Manwaring | 219/10.75 |
| 2,988,730 | 6/1961 | Prywes | 323/75 S |
| 3,538,427 | 11/1970 | Oltendorf | 323/24 |

OTHER PUBLICATIONS

H. F. Storm, "Magnetic Amplifiers", John Wiley & Sons, Inc., New York, 1955, pp. 112, 460–462.

Crow, "Saturating Core Devices", Edwards Bros. Inc., Ann Arbor, Mich., 1949, pp. 133, 134, 219, 220.

*Primary Examiner*—A. D. Pellinen

*Attorney, Agent, or Firm*—Seidel, Gonda & Goldhammer

[57] ABSTRACT

A direct current modulator provides double frequency variable A-C power to a load (such as an induction furnace or induction heater) specifically adapted to operate at the double frequency. The direct current modulator includes a saturable reactor bridge circuit having impedance balanced windings which function as magnetic valves. The windings are connected to provide first and second zero A-C potential terminals to which D-C magnetization current is connected. A source of D-C magnetization current is provided by a direct current circuit in which the modulated direct current flows. The direct current circuit includes the load, a rectifier and transformer connected to a source of A-C power. Capacitance and reactance may be provided in circuit with the load for bypassing the D-C component of the modulated D-C current which flows through the load. The direct current circuit including the rectifier and the transformer provides a low impedance path for the double frequency A-C component which modulates the D-C current in the D-C circuit. The direct current modulator provides variable A-C power at twice the source frequency through the load, the power being controlled as a direct function of the D-C current applied to the saturable bridge reactor circuit.

10 Claims, 3 Drawing Figures

DIRECT CURRENT MODULATOR FOR PROVIDING VARIABLE DOUBLE FREQUENCY ELECTRICAL POWER TO A LOAD

PRIOR APPLICATION

This application is a continuation-in-part of patent application Ser. No. 227,751 filed Feb. 22, 1972 for Saturable Reactor which application is a continuation-in-part of patent application Ser. No. 99,170 filed Dec. 17, 1970for Saturable Reactor now abandoned.

This invention relates to a direct current modulator for providing variable double frequency power to a load. More particularly, the present invention relates to a highly reliable direct current modulator for providing closely controlled single phase power at twice the source frequency to a load such as by way of example an induction furnace or induction heater specifically adapted to operate at the double frequency.

There is a need for providing variable power at twice the nominal source frequency (e.g., 2X 60 Hz) to loads over a relatively large range with a high degree of control. In the operation of induction furnaces for melting metals or induction heating devices such as are used for heating billets, it is desirable to provide power at twice the source frequency because of metallurgical, structural, or electrical requirements, or a combination of the foregoing. It has been suggested that such double frequency power be provided by frequency doublers, but attempts to do so have been at high cost and low reliablility. Moreover the range and degree of control of the power to the load has been limited in such frequency doublers. While in theory the move from paper design or laboratory curiosity to practical commercial frequency doublers appears straightforward, in practice it has been found that significant physical modifications must be made to achieve practical realization of the desired result. This is particularly true when dealing with frequency doublers which provide controlled variable power in the 0–10,000 KW range. At these power ranges, control and reliability problems become extremely difficult. If overdesigned, the change in power levels can take overly long; that is, the device is not responsive to changes in power level by means of variations in the D-C magnetization current. At the other extreme, the device becomes difficult to control and subject to dangerous power overruns; in other words, the device is unstable.

In designing a saturable reactor used to directly control power, the design approach has been to provide lower magnetic leakage in the space around the saturable reactor, better utilization of the magnetic qualities of the saturable iron core, lower D-C requirements, and larger KVA ratings, among other things. Some designs have been based upon torroidally wound magnetic cores wherein the A-C and D-C windings cover the entireties of the core to improve the range and performance of the saturable reactors. But the use of torroidally wound saturable reactors is limited, particularly in high voltage circuits because of insulation problems and the inherent instability of such devices. Also, magnetic leakage between the A-C and D-C windings limits the effect of the D-C control. This would be among the problems in designing a circuit according to U.S. Pat. 1,678,965 wherein the D-C and A-C windings are separately wound on the saturable cores.

The problem of magnetic leakage between the A-C and D-C windings is partially overcome by providing a saturable reactor bridge circuit having indentical magnetic iron cores with identical A-C windings with each core and winding functioning as a magnetic valve. The bridge is connected to provide a pair of terminals at which zero A-C potential exists and into which the D-C magnetization current can be introduced to flow through the windings in common with the A-C current. This provides full benefit of the direct current; that is, good transfer between the direct current and the A-C and hence full control. Another way of viewing it is that the direct current is capable of effectively reducing the overall impedance between the input A-C junctions over a large operating range of the reactor.

In U.S. Pat. No. 1,745,378 and the brief description in H. F. Storm, "Magnetic Amplifiers", John Wiley & Sons, Inc., New York, 1955, pages 112 and 460–462, the direct current flows through the windings in common with the A-C. The circuits, in and of themselves, do not provide a complete answer to the problems of providing power control over the full operating range of a high voltage and high power device; i.e., they do not solve the problems of voltage requirements, efficiency and power rating. The devices appear to be intended for low voltage, low power communication circuits.

It has been found that the range, efficiency and reliability of control for a saturable reactor bridge circuit directly controlling power to a load can be greatly increased if the D-C magnetization current is obtained from a low impedance circuit using a rectifier and deriving power through transformers from the same A-C source as the saturable reactor. Examination of the wave forms of the currents flowing through the circuit shows that control is maximized by making the wave shape of the A-C component of current flowing in the D-C circuit as close an approximation of a sine wave as possible. Also, the current parameters of the direct current circuit are such that the A-C reflected back through the primary of the transformer has a wave shape that is as close as possible to the wave shape of the A-C at its terminals of the saturable reactor bridge. This is achieved by reducing the impedance of the direct current circuit as much as possible. A low impedance rectifier is provided in the D-C circuit. The lower the impedance of the circuit, including the rectifier, the better the control over the saturable reactor.

The use of a low impedance rectifier in conjunction with a saturable reactor controlling power directly to a load, such as an induction furnace, has heretofore been successfully accomplished particularly for saturable reactors operating in the 0–10,000 KW range.

The present invention is a direct current modulator circuit for providing variable power to a load at twice the source frequency to a load specifically adapted to operate at the double frequency. Such load can be an induction furnace or induction heater. The direct current modulator circuit accurately controls the power over a large range. Moreover, the present direct current modulator circuit is commercially practical, economical and reliable.

In accordance with the present invention, a saturable reactor bridge circuit is connected directly across the A-C power terminals. The windings of such circuit are impedance balanced so as to provide first and second terminals at which there is zero A-C potential in the absence of a D-C magnetization current flowing through the windings. The D-C magnetization current is provided by a direct current circuit including a transformer whose primary is connected to the source of the A-C power and whose secondary is connected to a rectifier. The D-C output of the rectifier is connected in circuit with a load specifically designed to operate at twice the source frequency. The D-C outputs of the rectifier are also connected directly or through the load to the zero A-C potential terminals of the saturable reactor bridge. When A-C power and D-C magnetization current are applied to the saturable reactor bridge, a modulated direct current voltage appears across the inductive load the A-C component of which is at twice the source frequency and the value of this voltage can be reliably varied over the full range of power (e.g., 0–10,000 KW) by adjusting the level of the D-C current.

The foregoing is particularly applicable for controlling power to induction furnaces and induction heating devices which operate at relatively large voltages (≈ 2500V), currents (≈ 4000A) and power levels such as from zero to 10,000 KW.

One of the major unexpected advantages of the direct current modulator circuit of the present invention is the presence of approximately 10-15% more A-C voltage across the load than was anticipated.

Another advantage of the present invention is that there can be a saving in the amount of capacitance required for power factor connection.

For the purpose of illustrating the invention, there are shown in the drawings forms which are presently preferred; it being understood, however, that this invention is not limited to the precise arrangements and instrumentalities shown.

Figure 1:
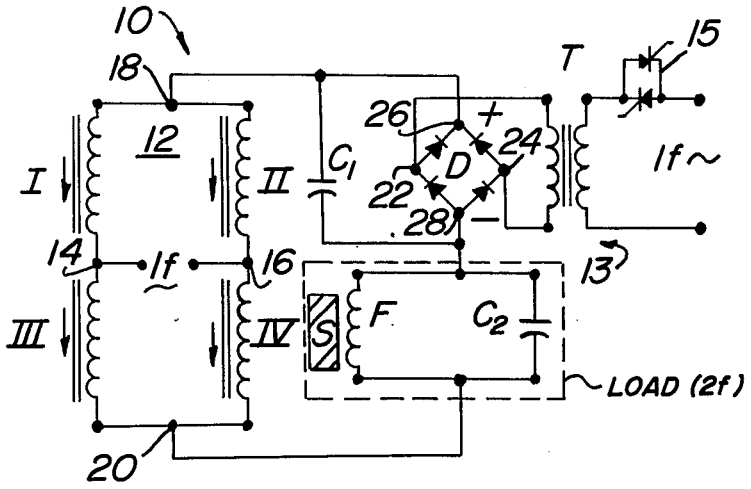
FIG. 1 is a schematic diagram illustrating a frequency doubler for providing variable A-C power at twice the frequency of the power source to an inductive load in accordance with the present invention.

Referring now to the drawings, in detail, wherein like numerals indicate like elements, there is shown in FIG. 1 a schematic illustration of a direct current modulator for providing variable A-C power at twice the frequency of the power source to a load. The direct current modulator circuit illustrated in FIG. 1 is designated generally as 10 and includes a saturable reactor bridge circuit which in the embodiment of FIG. 1 includes four identical A-C windings I, II, III, and IV wound on four identical saturable magnetic cores connected in a bridge circuit of the type generally referred to as a Wheatstone bridge. Alternating current at the frequency 1f is applied to the alternating current terminals 14 and 16 of the saturable reactor bridge 12. Such alternating current is nominally at line frequency as derived from a commercial power source; that is, at a frequency of 50 Hz or 60 Hz. Of course, other frequencies may be applied at the terminals 14 and 16 as desired.

Since each of the A-C windings and magnetic cores I–IV are identical, their impedance is also the same and hence the A-C voltage potential at the terminals 18 and 20 is zero in the absence of a D-C magnetization current applied at said terminals in the manner described below. Said terminals 18 and 20 may be referred to herein as the first and second zero A-C potential terminals of the saturable reactor bridge circuit.

A saturable reactor functions with a D-C control current which determines the magnetization of the saturable cores. For the saturable reactor bridge 12, the D-C magnetization current is provided by direct current circuit means 13 which includes a transformer T. The primary of the transformer T is connected to the source of alternating current through the thyristor circuit 15 (e.g., back-to-back SCRs) and hence is at the same frequency as said source. The thyristor circuit 15 controls the current to the primary of the transformer T so that the D-C magnetization current can be varied throughout the desired range. The gating circuits for the SCRs is conventional and therefore not described or shown. The secondary of the transformer T is connected to the A-C terminals 22 and 24 of the rectifier D which is shown as a bridge rectifier. Other forms of rectifiers can be used, such as the center tapped rectifier shown in FIG. 2. The bridge rectifier D has the minimum possible value of impedance to the alternating current at twice the source frequency ($2f$). For this purpose, solid state devices such as silicon rectifiers can be provided. D-C terminal 26 (marked +) of the bridge rectifier D is connected to zero A-C potential terminal 18 of the saturable reactor bridge circuit 12. D-C terminal 28 (marked −) is connected in series with a load F. The opposite terminal of the load F is connected to zero A-C potential terminal 20 of the saturable reactor bridge 12. The load F may be, by way of example, an induction furnace (such as a coreless induction furnace) or it may, by way of further example, be an inductive heating device such as may be used for heating billets. In the illustrated example, the inductive load is a coreless induction furnace and for that reason, it is shown as a coil or conductive winding and susceptor S. A capacitor $C_2$ for resonance and/or power factor correction is connected in parallel with the inductive load F.

Since the frequency doubler circuit 10 may from time to time be subject to surge or transient voltages, a capacitor C1 is connected across the D-C terminals 26 and 28 of the bridge rectifier D to protect the diodes in the rectifier bridge D.

From the foregoing, it will be observed that the direct current circuit 13 includes the bridge rectifier D, the transformer T, the capacitor $C_1$ and the load F together with the power factor correcting capacitor $C_2$. The load F is specifically designed to operate at double the input frequency $f$.

It has been previously indicated that the most desirable results are obtained when the impedance of the direct current circuit 13 is minimized. The inclusion of the load F in the D-C circuit is contrary to such previous indications. However, the significant advantages of the present invention are obtained by including a load specifically designed to operate at twice the input frequency $f$. More particularly, the load F is designed to maximize the impedance at the second harmonic of the frequency $f$. By doing this, the advantages of reliability, reduced cost and excellent control of the power across the full range of power variance are obtained. The design of inductive devices, such as induction heating equipment and induction furnaces to operate at a particular frequency is known to those skilled in the art and therefore need not be described in detail herein. It should be understood that the present invention is not specifically limited to use with induction heating and induction melting equipment as the load although these are the devices which the inventor specifically has in mind at the present time.

One of the major advantages of operating a device, such as an induction furnace or an induction heater at twice the power source frequency is that the amount of capacitance required for power factor correction is halved. Power factor correcting capacitors are a major cost item in any circuit for supplying power to an inductive load. Thus, the ability to double the frequency, provide variable power with a high degree of control to an inductive load and at the same time reduce the required power factor correcting capacity is a significant advantage of the present invention. The ability to halve the amount of required capacitance for power factor correction is brought home by noting that the KVA rating for such a capacitor is 8 to 10 times the power rating of the load.

With A-C power at line frequency connected to the terminals 14 and 16 of the saturable reactor bridge circuit and also to the primary of the transformer T, the direct current modulator circuit 10 functions as follows. With no D-C magnetization current applied to the terminals 18 and 20 of the saturable reactor bridge circuit 12, the overall impedance of the saturable reactor is at a maximum and there is zero A-C potential at said terminals 18 and 20. Accordingly, no current flows through the direct current circuit including the inductive load F.

Upon application of A-C potential at line frequency to the primary of the transformer T, the bridge rectifier D will apply a D-C magnetization current to the terminals 18 and 20. This magnetization current will flow in common with the A-C current through the windings I–IV and each of the cores will be magnetized in the direction indicated by the arrow adjacent to each of the saturable magnetic cores. The direction of magnetization is determined by the windings I–IV on each of the magnetic cores.

Analysis of each half cycle of the alternating current flowing into and through the saturable reactor bridge circuit 12 at the A-C terminals 14 and 16 shows that the sum of the A-C and D-C ampere turns in two of the windings is additive and in the other two windings it is subtractive. Thus, the impedance of two of the windings is decreased and the impedance of two other windings is increased. As a result, the A-C potential at the terminals 18 and 20 is no longer zero. Rather, it has a substantial value and a modulated direct current flow through the direct current circuit 13 including the bridge rectifier D and the load F. More importantly, the modulation frequency of the power flowing through the direct current circuit is twice the line A-C frequency $f$. In point of fact, the current actually flowing in the direct current circuit is a varying or pulsating D-C current. This is explained as follows.

Assume that the alternating current applied to the terminals 14 and 16 of the saturable reactor bridge 12 is such that during a particular half cycle terminal 16 is positive with respect to terminal 14. Accordingly, during this particular half cycle, current will follow the lowest impedance path through winding IV (wherein D-C and A-C ampere turns are additive), through terminal 20 to the load F, through the load circuit and through the bridge rectifier D from terminal 28 to terminal 26, and from there to terminal 18 of the saturable reactor. From terminal 18, the current will flow through winding I to the terminal 14 which, in the given example, was assumed to be negative with respect to terminal 16. Because the A-C and D-C ampere turns in windings II and III are subtractive. They function as high impedance reactors and very little A-C current flows through them.

On the succeeding half cycle, terminal 14 will be positive with respect to terminal 16. Accordingly, current will now flow through winding III wherein the A-C and D-C ampere turns are additive and hence the impedance is low, to terminal 20. From terminal 20, the current flows through the inductive load F, the bridge rectifier D from terminal 28 and 26 and back to terminal 18. From terminal 18, the current flows through now low impedance winding II to terminal 16. During the half cycle, windings I and IV carry very little of the half cycle A-C current because the A-C and D-C ampere turns are subtractive and hence their impedance is large compared to the impedance of windings III and II.

From the foregoing, it will be observed that during one complete cycle of the applied A-C potential terminals 14 and 16, two unidirectional current pulses have passed through the load F. Stated otherwise, the load F has had a voltage applied across its terminals at twice the frequency of the source $f$. In point of fact, the current is a pulsating D-C voltage or, stated otherwise, an A-C voltage at $2f$ with a D-C offset.

In the embodiment illustrated in FIG. 1 the D-C component actually flows through the inductive load (e.g., the furnace coil) but this is not specifically detrimental so long as the magnetic shielding cores of the furnace are not operating at excessively high magnetic flux densities.

It can be further observed in a study of the direct current modulator circuit 10 that the presence of an alternating current at $2f$ frequency (with a D-C offset) through the load F is determined by the presence or absence of a D-C magnetization current supplied by the bridge rectifier D. Moreover, the amount of D-C magnetization current supplied by said rectifier is a direct function of the amount of power delivered to the load F and hence provides control of the power.

In the operation of any such circuit, it is important that the D-C magnetization current provide a high degree of control throughout the entire range of power used by the load F. The bridge rectifier D provides this degree of control. As indicated above, the current actually flowing through the load F is a modulated direct current, or stated otherwise, a A-C current at twice the alternating current frequency ($2f$) with a D-C offset. The minimum impedance is illustrated by noting that at 4000 Amps A-C, the voltage drop across the bridge rectifier D is approximately 25 volts.

The function of the rectifier bridge D, in addition to its function as a rectifier of the A-C current in the secondary of the transformer T, is to convert the highly modulated pulsating D-C across it into an alternating current which is reflected back at the input terminals of the primary of the transformer T. The wave form of this current is substantially the same as the wave form of the A-C current at the terminals 14 and 16 and is in phase with it. Accordingly, the impedance to the pulsating direct current is further minimized. Thus, there is an interaction between the A-C power and the D-C magnetizing current input which significantly effects the range and efficiency of control of the frequency doubler 10. While the wave form of the current reflected back into the A-C power line may have some small amount of harmonics in it, these are at such low levels that they can be ignored for all practical purposes. The actual D-C power is only about 2% of the power being consumed by the entire direct current modulator. Another way of viewing it is to note that for a 10,000 KW load, the transformer T is supplying approximately 2% of 4000 Amperes or, stated otherwise, is operating at a voltage of approximately 40 to 50 volts. This can be explained as follows.

The current flowing through the saturable reactor bridge has a component which flows through the D-C circuit for providing the magnetization current. To this component current, as viewed from the saturable reactor bridge, there appears to be a very low impedance using the inventive circuit. At the same time, because of the essential identity of the A-C and D-C magnetic fields in the saturable reactor bridge, the D-C current may be run at a high enough value to reduce the impedance of the magnetically additive windings to zero in terms of the input voltage. Thus, the windings I–IV and their cores truly function as magnetic valves in that they either carry full current or practically no current at all during alternate half cycles. Power control of the output is thus under a high degree of control.

To restate the foregoing in somewhat different terms, a high degree of control of power to the inductive load F is achieved by providing a very low impedance to the A-C component which is impressed on the D-C current and is fed back into the direct current circuit and also by reducing the impedance of the windings to close zero during each alternate half cycle. The low impedance path permits the A-C component to freely modulate the direct current. Indeed, when viewing the modulated direct current wave forms on an oscilliscope, it is difficult to detect the D-C offset. The modulated direct current appears to swing from practically zero to full value. This also establishes that the load has no deleterious effect on control of the power to the load. Using the foregoing, it has been found that the A-C voltage across the load F at $2f$ can be varied from close to zero at zero D-C current to a maximum of approximately 70% of the A-C source at lf at full load. Very significantly, this is more than the anticipated 50% value. Such an increase is indeed unusual in circuits using saturable reactors where more often the result often falls below values anticipitated by paper designs.

Increasing the D-C flowing into the saturable reactor bridge circuit beyond a certain level will produce no significant increase in the $2f$ voltage across the load beyond the approximate 80% value for a fixed load impedance. However, adjustment of the load will permit increased power at the same approximate $2f$ voltage limit with increased D-C current. The increased D-C current in a broad way indicates a lower impedance to the A-C component which in turn accommodates the higher load current of higher power at essentially the same $2f$ voltage.

Although the saturable reactor bridge shown in FIG. 1 is illustrated as having four saturable magnetic cores, it is possible to use only two cores. This is because for each alternate half cycle of the circuit shown in FIG. 1 only two cores are used. During the next successive half cycle, the other two cores are used. Accordingly, two windings may be symmetrically disposed on the same core and with the appropriate electrical connections, the electrical operation is the same. This results in an economy in space as well as reduced cost for the two magnetic cores as compared to four cores.

Figure 2:
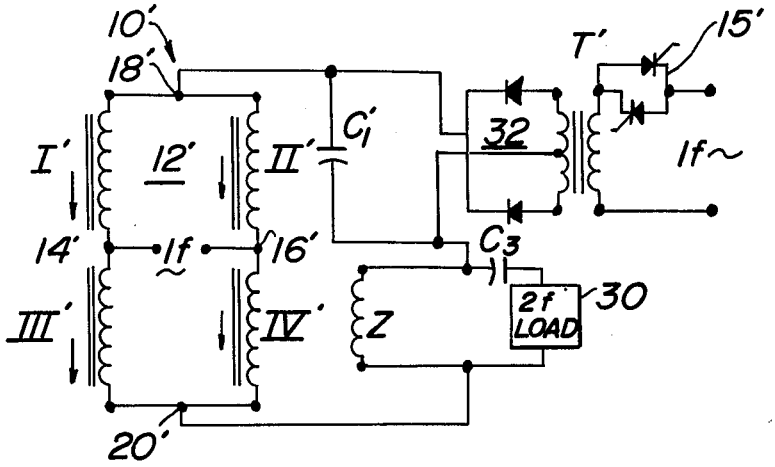
FIG. 2 is a schematic diagram illustrating another embodiment of the present invention.

Referring now to FIG. 2, there is shown another embodiment of the invention which is substantially similar to the frequency doubler circuit illustrated in FIG. 1 except circuit means are provided to prevent the D-C current component from passing through the load. In view of the similarity of the functional operation of the frequency doubler circuit illustrated in FIG. 2 with the frequency doubler circuit 10 illustrated in FIG. 1, like elements are indicated by like numerals except they are indicated as prime members. Moreover, the function of the circuit, where the same as that in FIG. 1, will not be explained to avoid unnecessary duplication.

In some applications, it may be desirable or even necessary to prevent the D-C magnetization current component from flowing through the inductive load. To accomplish this, the load 30 is connected in parallel with the reactor Z and in series with the capacitor $C_3$. The entire load circuit (comprising the aforesaid three circuit elements) is connected in series with the center tapped rectifier 32. The rectifier 32 is shown to illustrate another form of rectifier that may be used to accomplish the purposes of the invention. The advantage of the center tapped rectifier 32 is its high current carrying capacity. By designing the impedance of the reactor Z to be high for the $2f$ current but with a low D-C resistance, the average D-C current will pass with very low losses through said reactor Z. It should be indicated that the reactor Z should have a linear inductance through the operating range. The capacitor $C_3$ blocks the flow of any D-C through the load 30 while at the same time freely passing the A-C component of the $2f$ current. Other than the foregoing modifications, the frequency doubler 10' as shown in FIG. 2 operates as the frequency doubler 10 of FIG. 1 and may be designed in a like manner.

Figure 3:
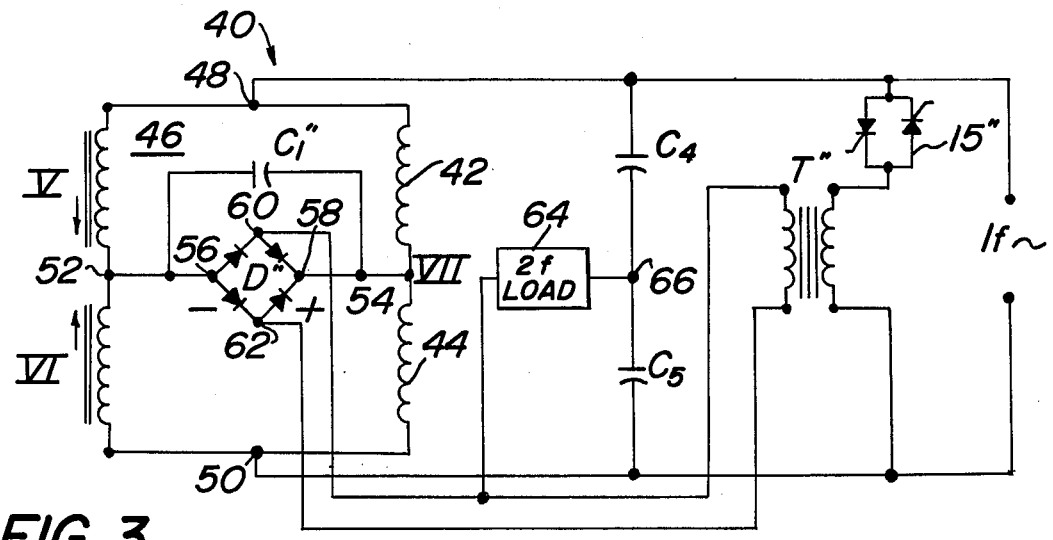
FIG. 3 is a schematic diagram illustrating yet another embodiment of the frequency doubler in accordance with the present invention.

In FIG. 3, there is shown another embodiment of the present invention wherein the double frequency to the load is isolated from the D-C offset.

In the direct current modulator 40 of FIG. 3, the saturable reactor bridge comprises a first winding V and a second winding VI which are identical in structure and wound on identical saturable cores. Windings V and VI are connected in parallel with reactor VII. Reactor VII is constructed so as to have a linear inductance in the operating range; that is, the two separate halves of the windings 42 and 44 are wound on a core which does not saturate in the operating range of the direct current modulator 40. More particularly, the reactor winding VII can be described as a center tapped reactor wherein the two halves of the windings 42 and 44 are wound so as to be magnetically highly coupled. Moreover, the windings 42 and 44 are designed so as to have a low electrical resistance.

Windings V, VI and VII together make up the saturable reactor bridge 46.

A source of alternating current at lf is connected to the input and output terminals 48 and 50 of the saturable reactor bridge 46. Because of the approximate identity of the windings V and VI as well as the halves 42 and 44 of the winding VII, terminals 52 and 54 are at zero A-C potential in the absence of a D-C magnetization current. The bridge rectifier D'' is connected such that its D-C output terminals 56 (marked −) and 58 (marked +) are connected to the terminals 52 and 54.

D-C magnetization current for the saturable windings V and VI is provided by the rectifier bridge D'' connected to the transformer T'' in the direct current circuit. The A-C input terminals 60 and 62 of the rectifier bridge D'' are connected to the secondary of the transformer T''. The primary of the transformer T'' is connected to the alternating current power source as shown. Moreover, the back to back SCRs 15'' control current to the primary of transformer T'' so as to vary the amount of D-C magnetization current for control purposes. A capacitor $C_1''$ is connected across the rectifier bridge D'' to provide protection against surge and transient currents.

Also connected across the A-C power source is capacitance which is illustrated as a pair of center tapped capacitors $C_4$ and $C_5$. The load 64, which may be an inductive load adapted to operate at a frequency (2*f*) which is double the frequency of the A-C power source, is connected between a capacitor center tap terminal 66 and one of the A-C input terminals of the bridge rectifier D''.

As previously indicated, winding halves 42 and 44 are magnetically coupled together. Moreover, they are wound so that they are magnetically additive. As thus constructed, the winding VII presents a high impedance to the A-C power at input and output terminals 48 and 50 of the saturable reactor bridge 46.

The rectifier bridge D'' magnetizes the saturable windings V and VI as indicated by the arrows adjacent to the cores. The windings on such core are wound so as to provide the indicated direction of magnetization. Accordingly, upon the application of a D-C magnetization current together with an A-C power source, winding V will present a low impedance to the flow of current when the voltage at terminal 48 is positive with respect to the voltage at terminal 50. AT the same time, winding VI will present a high impedance to such current. During the next alternate half cycle when the voltage at terminal 50 is positive with respect to terminal 48, winding VI will have a low impedance to the flow of current an winding V will have a high impedance. Thus, the windings on their respective cores V and VI function true magnetic valves in the manner explained above in respect to the embodiment of FIG. 1.

Given the foregoing, it can be explained how an alternating current at twice the power source frequency (2*f*) can be provided to the load 64. Assuming that terminal 48 is positive with respect to terminal 50, current flows from the A-C source through the saturable reactor winding V and then to the bridge rectifier D''. Current flow to the bridge rectifier D'' is effected because of the high impedance of winding VI and the low impedance of the bridge rectifier D''. At the bridge rectifier D'', the current flows from terminal 56 to terminal 60 to the load 64, to terminal 66, through capacitor $C_5$ and back to the A-C source. On the next half cycle when terminal 50 is positive with respect to terminal 48, current flows through winding VI, through the bridge rectifier D'' from terminal 56 to terminal 60, to the load 64, to terminal 66 and then through capacitor $C_4$ back to the source. The high impedance of the winding VII prevents current flow through it. Accordingly, a pulsating D-C current comprising an alternating current at twice the A-C source frequency (2*f*) with a D-C offset is flowing through the load 64.

Since the D-C outputs of the bridge rectifier D'' are connected to the terminals 52 and 54, this means that a pulsating D-C current will enter the terminal 54 which is the center tap of the winding VII. However, the winding VII adds relatively low impedance to the flow of such pulsating D-C current since the current divides at terminal 54 and flows in such a direction through both halves of the winding as to be magnetically subtractive. It should be indicated that the winding VII can use a torroidal or other continuous magnetic core without any air gaps and should be designed to prevent saturation by the D-C current.

Analysis of the operation of the direct current modulator circuit 40 shows that an excess charge will remain on each of the capacitors $C_4$ and $C_5$ during each current reversal of the A-C. This excess charge, however, helps provide the A-C current through the load 64. Moreover, the switching of the charge between capacitor $C_4$ and $C_5$ is aided by the winding halves 42 and 44 of the reactor VII which as indicated above are magnetically coupled and hence have a transformer action.

From the foregoing, it will be observed that each of the direct current modulator circuits described above provide variable power to a load at twice the frequency of the A-C power source. Power variation across the full range of the device is a direct function of the D-C magnetization current applied to a saturable bridge reactor through rectification means. The circuit is constructed so as to introduce the minimum impedance to the A-C component which tends to flow in the D-C circuit and also to be fed back through the transformer which provides power for the D-C magnetization current to the rectifying bridge. Good control and full use of the power range is obtained by the use of the low impedance path for the A-C component.

With respect to using the direct current modulator of the present invention for supplying electrical power at twice the line frequency to a coreless induction furnace, a further advantage is that the furnace requires fewer turns of conductor and hence may be mechanically stronger.

The present invention may be embodied in other specific forms without departing from the spirit or essential attributes thereof and, accordingly, reference should be made to the appended claims, rather than to the foregoing specification as indicating the scope of the invention.

I claim:

1. A direct current modulator for providing variable A-C power at twice the frequency of the power source to a load specifically adapted to operate at double the source frequency, comprising:

a load, a saturable reactor bridge circuit having two or more windings wound on saturable magnetic cores, said saturable reactor bridge circuit including A-C power source input and output terminals, said saturable reactor bridge circuit having impedance balanced windings to provide first and second zero A-C potential terminals in the absence of D-C magnetization current, D-C circuit means transformer coupled to said A-C power source for providing a source of magnetization current derived from the A-C power to the first and second terminals of said saturable reactor bridge circuit so that said D-C current flows through said saturable reactor bridge circuit windings with an A-C power source current, said D-C circuit means also converting the current across it to an A-C current which is reflected by said transformer coupling to said A-C power source, said load being connected in circuit with said D-C circuit, whereby a variable A-C power at twice the source frequency flows through said load, said double frequency A-C power to the load being a direct function of the D-C current applied to the saturable reactor bridge circuit from said D-C circuit means.

2. A direct current modulator in accordance with claim 1 wherein:

said saturable reactor bridge circuit includes four windings wound on saturable magnetic cores, said windings being connected as a Wheatstone bridge, and said D-C circuit means includes a transformer and a rectifier means having an A-C input and a D-C output, the primary of said transformer being connected to the A-C source and the secondary of said transformer being connected to the A-C input of said rectifier means, the D-C output of said rectifier means having one terminal connected to the first zero A-C potential terminal of the saturable reactor bridge circuit and the other terminal being connected to one terminal of said load, the other terminal of said load being connected to the second zero A-C potential terminal of said saturable reactor bridge.

3. A direct current modulator in accordance with claim 2 including a capacitor connected across the D-C output terminals of the rectifier means to protect the rectifier components of said bridge rectifier against surge or transient voltages.

4. A direct current modulator in accordance with claim 1 wherein said load is an induction furnace and a power factor correcting capacitor.

5. A direct current modulator in accordance with claim 1 wherein said load is an induction heater and a power factor correcting capacitor.

6. A direct current modulator in accordance with claim 2 wherein said load is an induction furnace and a power factor correcting capacitor.

7. A direct current modulator in accordance with claim 2 wherein said load is an induction heater and a power factor correcting capacitor.

8. A direct current modulator in accordance with claim 2 wherein said load is operatively connected to means for bypassing the D-C component of the double frequency current passing through the load.

9. A direct current modulator in accordance with claim 8 wherein said D-C component bypass means includes a winding having a low resistance but a high reactance at double the source frequency and a capacitor connected in series with said load to block the D-C component, said capacitor having sufficient capacitance to provide a power factor correction for said load said winding being connected in shunt with said capacitor and load.

10. A direct current modulator in accordance with claim 1 wherein said saturable reactor bridge circuit includes two windings wound on saturable magnetic cores and two windings wound on nonsaturable magnetic cores, said D-C circuit means comprising a transformer and rectifier means having an A-C input and D-C output, the primary of said transformer being connected to the A-C power source and the secondary of said transformer being connected to the A-C input of said rectifier means, the D-C output of said rectifier means being connected to said first and second A-C zero potential terminals, and center tapped capacitor means connected across the A-C input terminals of said saturable reactor, and said load being connected between a center tap terminal of said capacitive means and one A-C input terminal of said rectifier means.

* * * * *